US008813911B2

(12) United States Patent
Fuqua et al.

(10) Patent No.: US 8,813,911 B2
(45) Date of Patent: Aug. 26, 2014

(54) TACTICAL VEHICLE WITH LINE DEPLOYMENT TOWER

(75) Inventors: Charles L. Fuqua, Woodbridge, VA (US); Steven S. Kahre, Spotsylvania, VA (US)

(73) Assignee: Patriot3, Inc., Fredericksburg, VA (US)

( * ) Notice: Subject to any disclaimer, the term of this patent is extended or adjusted under 35 U.S.C. 154(b) by 1520 days.

(21) Appl. No.: 11/725,357

(22) Filed: Mar. 19, 2007

(65) Prior Publication Data

US 2010/0276227 A1 Nov. 4, 2010

(51) Int. Cl.
*B66C 23/00* (2006.01)

(52) U.S. Cl.
USPC ..... 182/69.6; 182/48; 182/190; 182/3; 212/258

(58) Field of Classification Search
USPC ..... 182/127, 63.1, 68.1, 69.6, 48, 129, 49, 182/3, 2.5, 2.1, 190, 141; 296/3; 212/301, 212/258, 343, 323–325
See application file for complete search history.

(56) References Cited

U.S. PATENT DOCUMENTS

| | | | | | |
|---|---|---|---|---|---|
| 317,899 | A | | 5/1885 | Ward | |
| 483,001 | A | * | 9/1892 | Hughes | 182/51 |
| 1,337,667 | A | * | 4/1920 | Reynolds | 212/98 |
| 1,718,979 | A | * | 7/1929 | Protzeller | 182/62.5 |
| 2,425,663 | A | * | 8/1947 | Wooldridge | 212/288 |
| 2,558,975 | A | | 7/1951 | Moreno et al. | |
| 2,777,737 | A | * | 1/1957 | Balogh | 182/1 |
| 2,782,943 | A | * | 2/1957 | Jones et al. | 414/508 |
| 2,815,250 | A | * | 12/1957 | Thornton-Trump | 182/2.8 |
| 2,828,166 | A | * | 3/1958 | Herring | 182/101 |
| 2,829,741 | A | * | 4/1958 | Selberg et al. | 52/121 |
| 2,909,290 | A | * | 10/1959 | Nichols | 212/195 |
| 2,936,913 | A | * | 5/1960 | Watt et al. | 414/393 |
| 3,005,559 | A | * | 10/1961 | Toderick | 212/280 |
| 3,058,600 | A | * | 10/1962 | Gosnell et al. | 212/203 |
| 3,180,622 | A | * | 4/1965 | Romeo | 212/309 |
| 3,247,987 | A | * | 4/1966 | Lake | 414/732 |
| 3,405,815 | A | * | 10/1968 | Wadefelt | 414/141.4 |
| 3,451,504 | A | * | 6/1969 | Logan | 182/1 |
| 3,513,997 | A | * | 5/1970 | Spitzer et al. | 414/541 |
| 3,584,703 | A | * | 6/1971 | Lane | 182/127 |
| 3,598,347 | A | * | 8/1971 | Marburger | 248/654 |
| 3,605,943 | A | * | 9/1971 | Beaudet et al. | 82/66.2 |
| 3,664,456 | A | * | 5/1972 | Smith et al. | 182/62.5 |
| 3,685,673 | A | * | 8/1972 | Schweis | 414/547 |
| 3,785,503 | A | * | 1/1974 | Butterfield et al. | 212/289 |

(Continued)

OTHER PUBLICATIONS

Definition of cantilever provided in Final Action The American Heritage® Dictionary of the English Language, Fourth Edition copyright © 2000 by Houghton Mifflin Company. Updated in 2009. Published by Houghton Mifflin Company. All rights reserved.*

(Continued)

*Primary Examiner* — Katherine Mitchell
*Assistant Examiner* — Daniel Cahn
(74) *Attorney, Agent, or Firm* — Schwartz Law Firm, P.C.

(57) ABSTRACT

A tactical vehicle incorporates a line deployment tower adapted for use by personnel transferring between an elevated location on the vehicle and a remote target location. The line deployment tower includes a base mounted to the vehicle at the elevated location. An elongated line boom has a proximal end attached to the base, and an opposite distal end. A flexible line is secured to the distal end of the line boom, and is adapted for extending downward from the elevated location when deployed.

14 Claims, 6 Drawing Sheets

(56) References Cited

U.S. PATENT DOCUMENTS

| | | | | | |
|---|---|---|---|---|---|
| 3,800,912 | A * | 4/1974 | Ashworth | 182/2.7 |
| 3,868,022 | A * | 2/1975 | Greenlay et al. | 212/291 |
| 3,910,264 | A * | 10/1975 | Mahieu | 182/69.4 |
| 4,016,688 | A * | 4/1977 | Tiffin et al. | 52/118 |
| 4,020,952 | A * | 5/1977 | Scodino | 414/745.6 |
| 4,042,116 | A * | 8/1977 | Bertolino | 212/258 |
| 4,053,060 | A * | 10/1977 | Wilson | 212/302 |
| 4,098,532 | A * | 7/1978 | Phillips | 294/75 |
| 4,339,019 | A * | 7/1982 | Tracy | 182/47 |
| 4,383,791 | A * | 5/1983 | King | 414/542 |
| 4,613,155 | A * | 9/1986 | Greenwood | 280/760 |
| 4,666,049 | A * | 5/1987 | Gilmore, Jr. | 212/175 |
| 4,708,251 | A * | 11/1987 | Picard et al. | 212/294 |
| 4,744,718 | A * | 5/1988 | Logan et al. | 414/724 |
| 4,754,840 | A * | 7/1988 | MacDonald et al. | 182/2.3 |
| 4,838,438 | A * | 6/1989 | Ishige et al. | 212/284 |
| 4,930,970 | A * | 6/1990 | Sunderland | 414/542 |
| 4,946,051 | A * | 8/1990 | Cliff | 212/258 |
| 5,295,555 | A * | 3/1994 | Strange | 182/2.5 |
| 5,299,653 | A * | 4/1994 | Nebel | 182/2.7 |
| 5,362,029 | A * | 11/1994 | Kallenberger | 254/269 |
| 5,392,936 | A * | 2/1995 | Solomon et al. | 212/258 |
| 5,727,645 | A * | 3/1998 | Woodling | 182/2.1 |
| 6,276,488 | B1 * | 8/2001 | Divine et al. | 182/2.11 |
| 6,405,831 | B1 * | 6/2002 | Daniel, III | 182/127 |
| 6,467,576 | B2 * | 10/2002 | Figura et al. | 182/63.1 |
| 6,609,622 | B2 * | 8/2003 | Forsyth | 212/258 |
| 6,802,391 | B2 * | 10/2004 | Ganiere | 182/69.6 |
| 6,832,667 | B1 * | 12/2004 | Kahre et al. | 182/127 |
| 7,182,173 | B2 * | 2/2007 | Bailey | 182/2.1 |
| 7,246,682 | B1 | 7/2007 | Hatch | |
| 7,448,470 | B2 * | 11/2008 | Brown et al. | 182/63.1 |
| 7,836,536 | B2 * | 11/2010 | Motohashi et al. | 14/71.5 |
| 8,407,840 | B2 * | 4/2013 | Fleischer et al. | 14/34 |
| 8,622,173 | B2 * | 1/2014 | Fuqua et al. | 182/63.1 |
| 2003/0000769 | A1 * | 1/2003 | Pyle | 182/63.1 |
| 2004/0118635 | A1 * | 6/2004 | Sun et al. | 182/142 |
| 2006/0045687 | A1 * | 3/2006 | Finley | 414/462 |
| 2006/0065485 | A1 * | 3/2006 | Reed | 182/82 |
| 2007/0181363 | A1 * | 8/2007 | Denison | 182/48 |
| 2007/0215409 | A1 * | 9/2007 | Boscher et al. | 182/3 |
| 2007/0246435 | A1 * | 10/2007 | Crookston | 212/264 |
| 2009/0008186 | A1 * | 1/2009 | Taylor et al. | 182/48 |
| 2009/0084748 | A1 * | 4/2009 | Styck et al. | 212/258 |
| 2010/0061808 | A1 * | 3/2010 | Smith et al. | 405/184.4 |
| 2010/0276228 | A1 * | 11/2010 | Lombardi | 182/63.1 |
| 2011/0047723 | A1 * | 3/2011 | Fleischer et al. | 14/69.5 |

OTHER PUBLICATIONS

Defintion of jog provided in Final Action The American Heritage® Dictionary of the English Language, Fourth Edition copyright © 2000 by Houghton Mifflin Company. Updated in 2009. Published by Houghton Mifflin Company. All rights reserved.*

Definition of lateral provided in Final Action the American Heritage® Dictionary of the English Language, Fourth Edition copyright © 2000 by Houghton Mifflin Company. Updated in 2009. Published by Houghton Mifflin Company. All rights reserved.*

The definition of 'body' can be found in the Action The American Heritage® Dictionary of the English Language, Fourth Edition copyright © 2000 by Houghton Mifflin Company. Updated in 2009. Published by Houghton Mifflin Company. All rights reserved.*

The definition of 'runway' can be found in the Action The American Heritage® Dictionary of the English Language, Fourth Edition copyright © 2000 by Houghton Mifflin Company. Updated in 2009. Published by Houghton Mifflin Company. All rights reserved.*

* cited by examiner

TACTICAL VEHICLE WITH LINE DEPLOYMENT TOWER

TECHNICAL FIELD AND BACKGROUND

The invention relates generally to a line deployment tower, a tactical vehicle incorporating a line deployment tower, and a method for transferring personnel between an elevated location on a tactical vehicle and a remote target location.

SUMMARY OF EXEMPLARY EMBODIMENTS

Therefore, it is an object of the invention to provide a line deployment tower applicable for use in tactical vehicle, and a method for transferring personnel between an elevated location on a tactical vehicle and a remote target location.

These and other objects of the present invention are achieved in the exemplary embodiments disclosed below by providing a tactical vehicle which incorporates a line deployment tower adapted for use by personnel transferring between an elevated location on the vehicle and a remote target location. The line deployment tower includes a base mounted to the vehicle at the elevated location. An elongated line boom has a proximal end attached to the base, and an opposite distal end. A flexible line is secured to the distal end of the line boom, and is adapted for extending downward from the elevated location when deployed.

The term "tactical vehicle" refers broadly herein to any self-propelled, boosted, or towed military and non-military (e.g., police) conveyance capable of transport by land, sea, or air. The vehicle may have wheels, tracks, skids, floats, and/or other maneuvering structure.

The term "elevated location" refers to any point on the vehicle above the underlying surface or area over which the vehicle travels. The term "remote location" refers to any point at any horizontal and/or vertical distance from the elevated location.

The term "line boom" refers to any elongated structure (disposed vertically, horizontally, or otherwise) applicable for supporting a flexible line.

According to another exemplary embodiment of the invention, means are provided for pivotably attaching the line boom to the base, such that the line boom is movable between a line-stowing position and a line-deploying position. The attachment means may comprise, for example, cooperating pins and brackets.

According to another exemplary embodiment of the invention, a boom cable is adapted for holding the line boom in the line-deploying position.

According to another exemplary embodiment of the invention, an anchor plate is located between the distal and proximal ends of the line boom, and defines at least one anchoring point for attaching the boom cable to the line boom.

According to another exemplary embodiment of the invention, a personnel runway extends from a body of the vehicle towards the base of the line deployment tower.

According to another exemplary embodiment of the invention, means are provided for mechanically elevating the runway. The elevating means may comprise, for example, a hydraulic lift.

According to another exemplary embodiment of the invention, the base includes an extension ramp attached to the runway.

According to another exemplary embodiment of the invention, the base further includes a mounting beam attached to the extension ramp, and having a cantilevered end projecting substantially perpendicular to a direction of the runway.

According to another exemplary embodiment of the invention, the proximal end of the line boom is attached to the mounting beam in an area of the cantilevered end.

According to another exemplary embodiment of the invention, the distal end of the line boom defines a lateral jog projecting in a direction opposite the cantilevered end of the mounting beam.

According to another exemplary embodiment of the invention, an anchor plate is located at the distal end of the line boom, and defines at least one anchoring point for attaching the line to the line boom.

According to another exemplary embodiment of the invention, the line boom includes first and second laterally-spaced uprights.

According to another exemplary embodiment of the invention, first and second spaced-apart mounting boots are attached to the mounting beam. The mounting boots receive respective uprights at the proximal end of the line boom.

According to another exemplary embodiment of the invention, each of the mounting boots includes a U-shaped bracket.

According to another exemplary embodiment of the invention, first and second mounting pins extend through respective U-shaped brackets and through respective first and second uprights to pivotably attach the line boom to the base.

According to another exemplary embodiment of the invention, at least one cross-member interconnects the uprights.

According to another exemplary embodiment of the invention, a reinforcing web extends between the first and second uprights at the distal end of the line boom.

According to another exemplary embodiment of the invention, the flexible line comprises a twisted rope having a cordage diameter greater than 0.5 inches. Alternatively, the flexible line may comprise any other rope, cable, bungee, strap, wire, or the like.

In another exemplary embodiment, the invention comprises a vehicle-mounted line deployment tower adapted for use by personnel transferring between an elevated location on a vehicle and a remote target location. The line deployment tower includes a base designed for mounting to the vehicle at the elevated location. An elongated line boom has a proximal end attached to the base, and an opposite distal end. Means are provided for pivotably attaching the line boom to the base, such that the line boom is movable between a line-stowing position and a line-deploying position. A flexible line attaches to the distal end of the line boom, and is adapted for extending vertically downward from the line boom upon movement of the line boom from the line-stowing position to the line-deploying position.

In yet another exemplary embodiment, the invention comprises a method for transferring personnel between an elevated location on a tactical vehicle and a remote target location. The method includes the steps of deploying a flexible line secured to an elongated line boom mounted to the vehicle at the elevated location, approaching the flexible line along a personnel runway extending from a body of the vehicle towards the elevated location, and grasping the flexible line and maneuvering from the elevated location to the remote target location.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Like numbers refer to like elements throughout. As used herein, the article "a" is intended to include one or more items. Where only one item is intended, the term "one" or similar language is used. Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. Any references to advantages, benefits, unexpected results, or operability of the present invention are not intended as an affirmation that the invention has been previously reduced to practice or that any testing has been performed.

Figure 1:
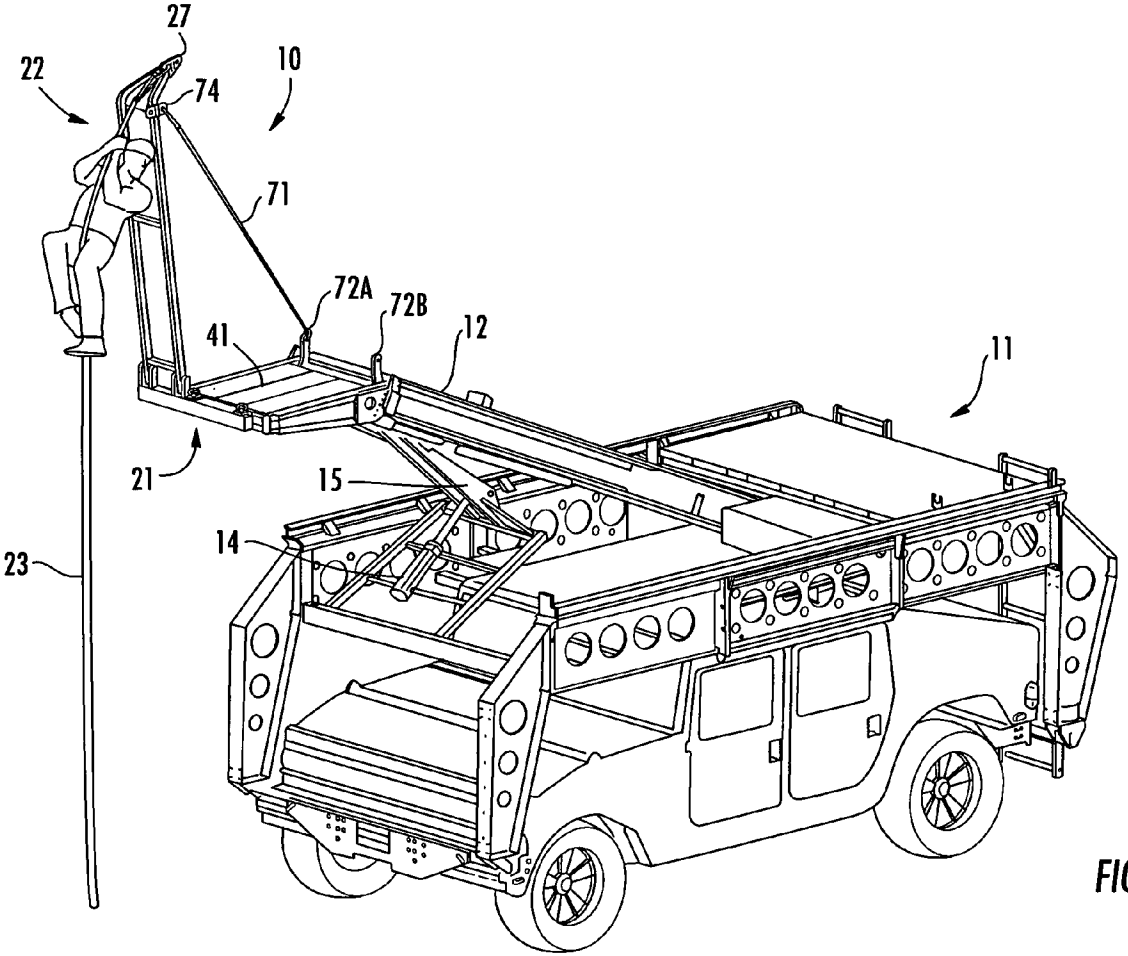
FIG. 1 is a perspective view of a self-propelled tactical vehicle incorporating a line deployment tower according to one exemplary embodiment of the present invention.

Referring now specifically to the drawings, a line deployment tower according to one exemplary embodiment of the invention is illustrated in FIG. 1, and shown generally at reference numeral 10. In the embodiment shown, the line deployment tower 10 is incorporated in a self-propelled tactical vehicle 11 comprising a personnel runway 12 extending from a body of the vehicle towards an elevated location proximate the tower 10. The runway 12 may be vertically adjustable via a hydraulic actuator 14 and telescoping scissors frame 15. In other implementations, the line deployment tower 10 may be incorporated in any other self-propelled, boosted, or towed vehicle having wheels, tracks, skids, floats, and/or other maneuvering structure.

Figure 2:
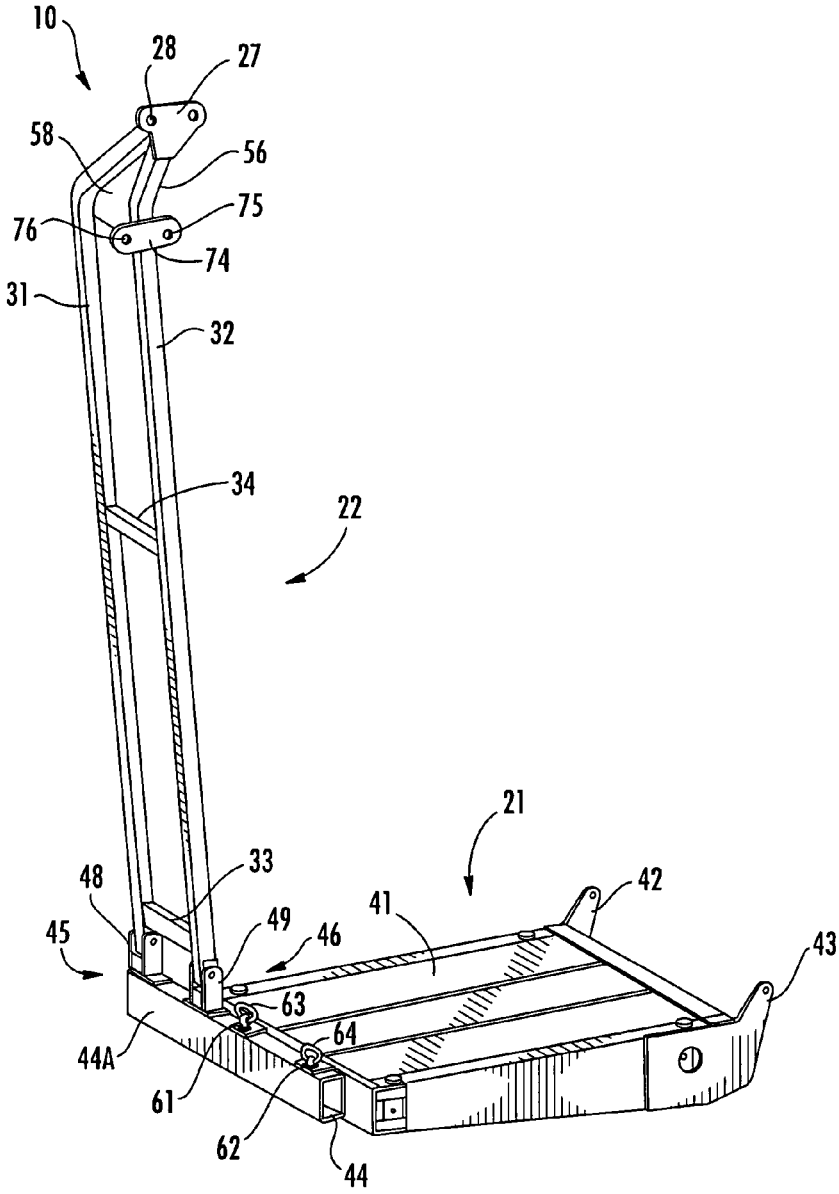
FIG. 2 is a perspective view of the line deployment tower removed from the vehicle, and showing the boom located in the line-deploying position (with the rope removed)

As best shown in FIGS. 1 and 2, the line deployment tower 10 includes a base 21 mounted to the vehicle 11 at an end of the runway 12, an elongated rigid boom 22 attached at its proximal end to the base 21, and a flexible rope 23 secured to a distal end of the boom 22. When deployed, as described below, the rope 23 extends downward from the elevated location and offers a safe, fast, and convenient means for transfer of personnel from the vehicle 11 to a remote target location. The rope 23 may comprise a twisted hemp having a cordage diameter of between 0.5 and 1.5 inches. A conventional spring clip 25 (FIG. 4) or other suitable connector may be used to releasably attach the rope 23 to an anchor plate 27 located at the distal end of the boom 22. Preferably, the clip 25 attaches to an outside one of two holes 28, 29 formed with the anchor plate 27. The boom 22 comprises spaced uprights 31, 32 and cross-members 33, 34, described further below.

Figure 3:
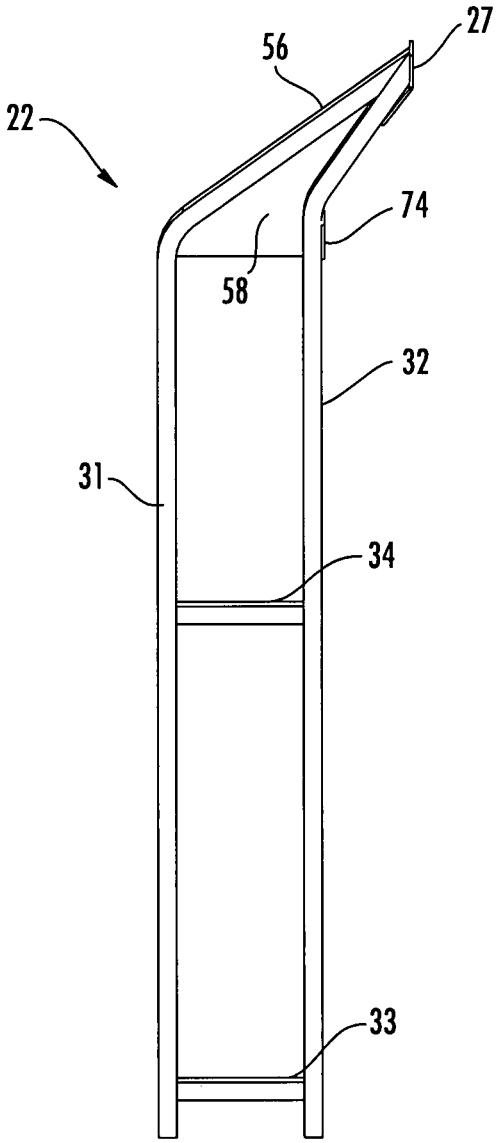
FIG. 3 is a front view of the rigid boom removed from the line deployment tower.
Figure 4:
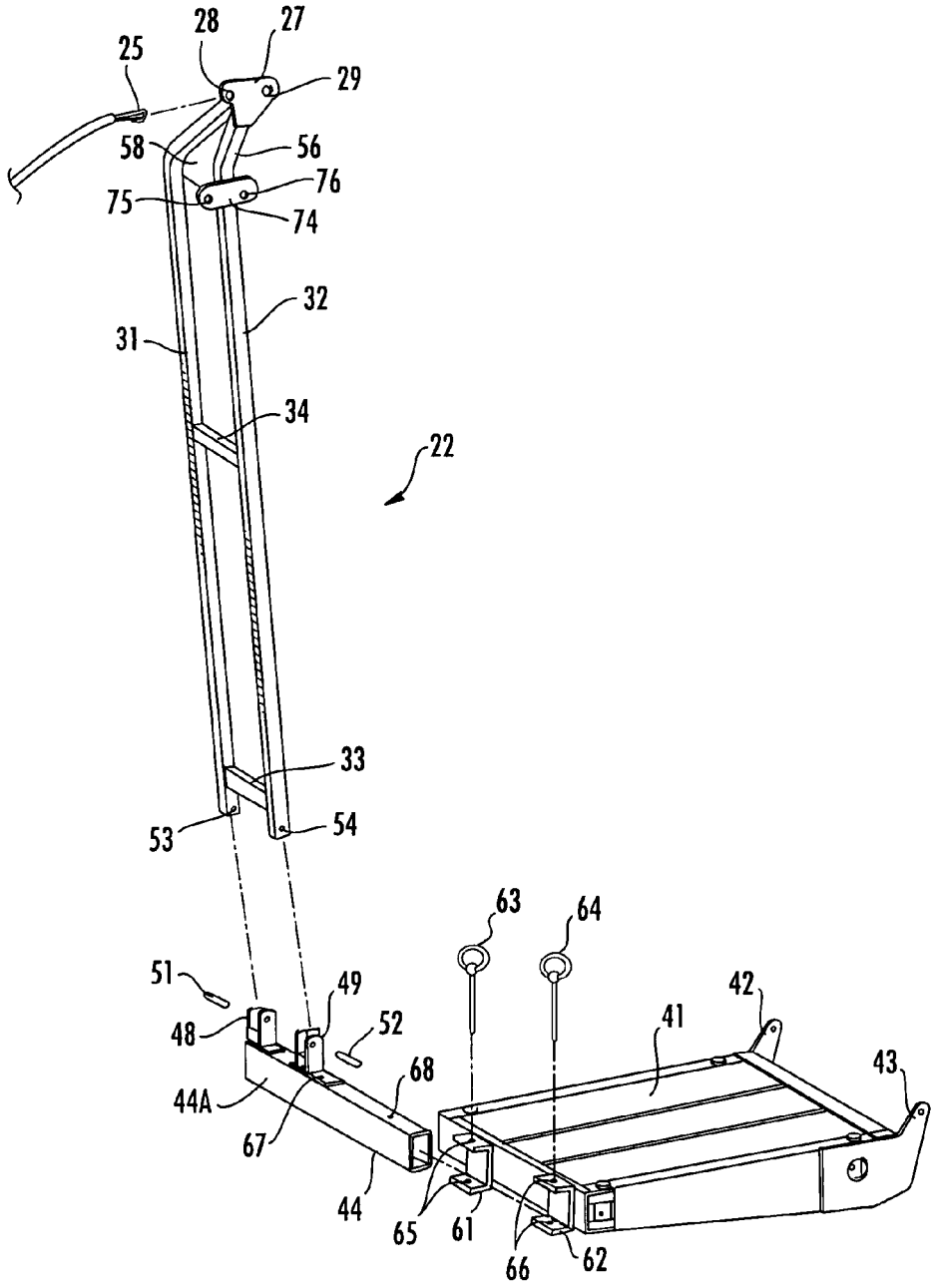
FIG. 4 is a perspective view of the line deployment tower with various components exploded away.

Referring to FIGS. 2, 3, and 4, in one exemplary embodiment, the base 21 comprises an extension ramp 41 having spaced-apart mounting ears 42, 43 designed for connecting to the personnel runway 12. A mounting beam 44 is located at a front edge of the ramp 41, and has a cantilevered end 44A which projects outwardly generally perpendicular to the direction of the runway 12. First and second mounting boots 45, 46 are affixed to the cantilevered end 44A of the mounting beam 44, and comprise respective U-shaped brackets 48, 49 and pivot pins 51, 52 (See FIG. 4). The pivot pins 51, 52 extend through the U-shaped brackets 48, 49 and through holes 53, 54 formed with respective uprights 31, 32 to pivotably attach the boom 22 to the base 21. As best shown in FIGS. 2 and 3, the spaced uprights 31, 32 converge at the distal end of the boom 22 and form a lateral jog 56 (or bend) which projects in a direction opposite the cantilevered end 44A of the mounting beam 44, such that the rope anchoring plate 27 resides generally above a center area of the ramp 41. This construction allows substantially unobstructed access to the rope 23 for quick maneuvering from the vehicle 11 to the target location, as demonstrated in FIG. 1. The uprights 31, 32 may be constructed of a relatively lightweight aluminum or titanium alloy, and may be further interconnected at the distal end of the boom 22 by a reinforcing metal web 58.

Figure 5:
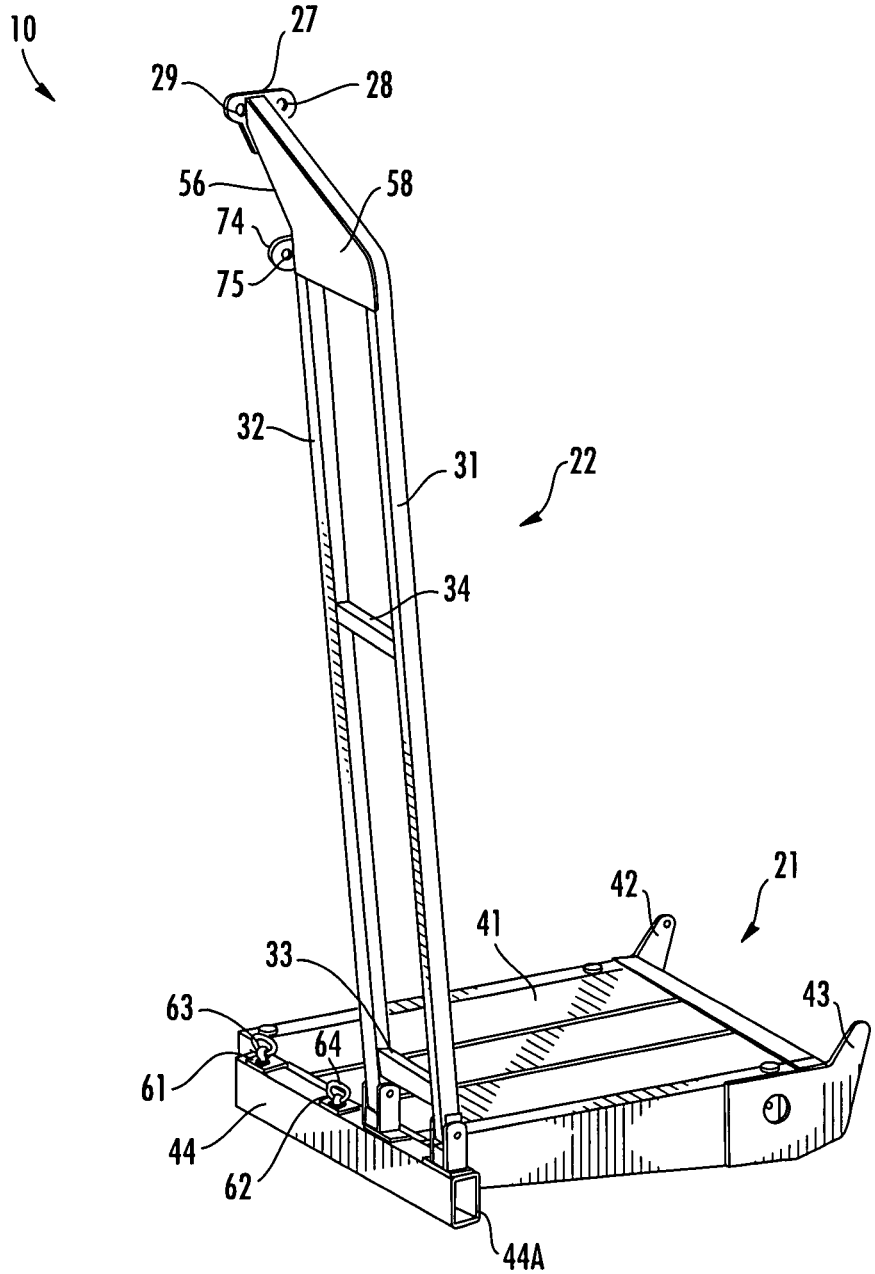
FIG. 5 is a perspective view of the line deployment tower removed from the vehicle, and turned 180 degrees to mount on an opposite side of the extension ramp.

As shown in FIGS. 2 and 4, the mounting beam 44 may be removably secured to the ramp 41 by spaced metal C-brackets 61, 62 and ring pins 63, 64. The ring pins 63, 64 are designed to extend through respective sets of vertically aligned holes 65, 66, 67, and 68 formed with the brackets 61, 62 and mounting beam 44. The brackets 61, 62 may be affixed to the ramp 41 by welding, bolts, rivets, or other suitable means. With the pins 63, 64 removed, the mounting beam 44 can be turned 180 degrees such that the cantilevered end 44A extends outwardly from an opposite side of the ramp 41, as shown in FIG. 5. In this position, the lateral jog 56 of the boom 22 again projects generally towards the center area of the ramp 41, and the rope 23 attaches to the second (now outside) hole 29 in the anchor plate 27.

In either orientation of the tower 10 discussed above, the pivoted boom 22 is held in a slightly outwardly-angled, line-deploying position by a flexible boom cable 71 shown in FIG. 1. With the tower 10 oriented as shown in FIGS. 1 and 2, the boom cable 71 is attached at one end to a raised tab 72A fixed to the personnel runway 12 adjacent a boom-side of the ramp 41. The opposite end of the boom cable 71 is releasably attached to a second anchor plate 74 mounted to the boom 22 beneath the plate 27. A spring clip or other suitable connector (not shown) may be attached to the boom cable 71, and pass through a nearside one of two holes 75, 76 formed with the anchor plate 74. When the tower 10 is turned 180 degrees to the orientation shown in FIG. 5, the boom cable 71 attaches at one end to the opposite runway tab 72B, and at its other end to the opposite hole 75, 76 of the anchor plate 74.

Figure 6:
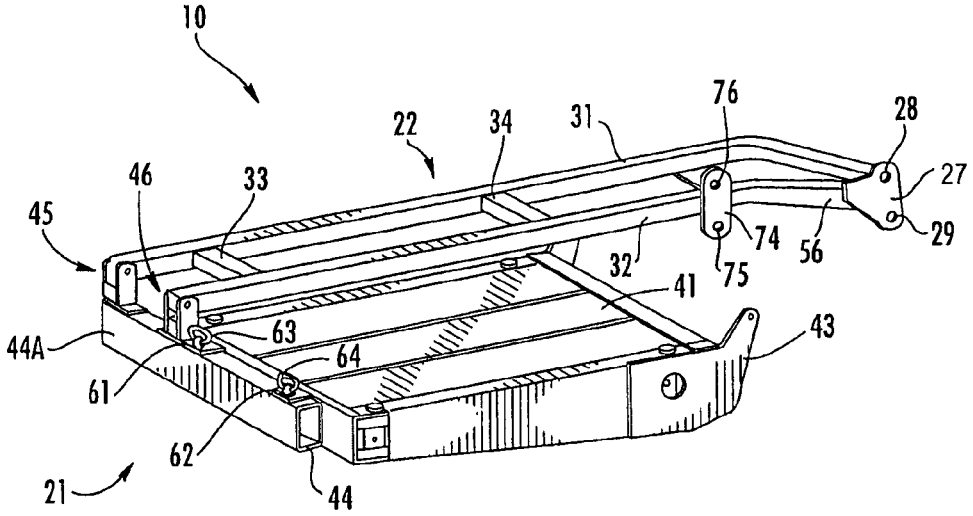
FIG. 6 is a perspective view of the line deployment tower removed from the vehicle, and showing the boom pivoted down into the line-stowing position (with the rope removed).

When not in use, the line deployment tower 10 is readily stowed by pivoting the boom 22 to the line-stowing position shown in FIG. 6. In this position, the boom cable 71 remains attached to the boom 22 and to the runway tab 72A, 72B, as previously described. The rope 23 may be coiled, folded or otherwise gathered in an area of the ramp 41. Thereafter, the rope 23 is quickly and readily deployed by simply folding the boom 22 outwardly to the line-deploying position shown in FIG. 1.

Exemplary embodiments of the present invention are described above. No element, act, or instruction used in this description should be construed as critical or essential to the invention unless explicitly described as such. Various details of the invention may be changed without departing from its scope. Furthermore, the foregoing description of the exemplary embodiments of the invention and best mode for practicing the invention are provided for the purpose of illustration only and not for the purpose of limitation—the invention being defined by the claims and their equivalents.

We claim:

1. A tactical vehicle comprising:

a line deployment tower adapted for use by personnel transferring between an elevated location above a body of said vehicle and a remote target location spaced from said vehicle; and a personnel runway having a proximal end pivotably attached to the body of said vehicle and a distal end adapted for extending outwardly and upwardly from the body of said tactical vehicle towards said line deployment tower at the elevated location; and means for mechanically elevating said personnel runway; and said line deployment tower comprising:

a base mounted to the distal end of said personnel runway at the elevated location, an elongated line boom having a proximal end attached to said base, and an opposite distal end, said line boom comprising first and second uprights laterally spaced apart from each other at the proximal end of said line boom and extending outwardly from the proximal end to the distal end of said line boom, said line boom being moveable between an upwardly pivoted line-deploying position in which said first and second uprights extend upwardly and outwardly from said base, and a downwardly pivoted line-stowing position in which said first and second uprights extend substantially adjacent and parallel to a top major surface of said base, and means for pivotably attaching the first and second uprights of said line boom to said base; and a flexible line secured to the distal end of said line boom, and said line adapted for extending downward from the elevated location to the remote target location when said line boom is in said line-deploying position.

2. A tactical vehicle according to claim 1, and comprising a boom cable adapted for holding said line boom in the line-deploying position.

3. A tactical vehicle according to claim 2, and comprising an anchor plate located between the distal and proximal ends of said line boom, and defining at least one anchoring point for attaching said boom cable to said line boom.

4. A tactical vehicle according to claim 1, wherein said base comprises an extension ramp attached to said runway.

5. A tactical vehicle according to claim 4, wherein said base further comprises a mounting beam attached to said extension ramp, and having a cantilevered end projecting substantially perpendicular to a direction of said runway.

6. A tactical vehicle according to claim 5, wherein the proximal end of said line boom is attached to said mounting beam in an area of the cantilevered end.

7. A tactical vehicle according to claim 6, wherein the distal end of said line boom defines a lateral jog projecting in a direction opposite a direction of the cantilevered end of said mounting beam.

8. A tactical vehicle according to claim 7, and comprising an anchor plate located at the distal end of said line boom, and defining at least one anchoring point for attaching a boom cable to said line boom.

9. A tactical vehicle according to claim 1, wherein said means for pivotably attaching the first and second uprights of said line boom to said base, comprises first and second spaced-apart mounting boots attached to said base, and said first and second spaced-apart mounting boots respectively receive said first and second uprights at the proximal end of said line boom.

10. A tactical vehicle according to claim 9, wherein each of said mounting boots comprises a U-shaped bracket.

11. A tactical vehicle according to claim 10, and comprising first and second mounting pins respectively extending through said U-shaped brackets and respectively through said first and second uprights to pivotably attach said line boom to said base.

12. A tactical vehicle according to claim 11, and comprising at least one cross-member interconnecting said uprights.

13. A tactical vehicle according to claim 12, and comprising a reinforcing web extending between said first and second uprights at the distal end of said line boom.

14. A tactical vehicle according to claim 1, wherein said flexible line comprises a twisted rope having a cordage diameter greater than 0.5 inches.

* * * * *